US008961132B2

(12) United States Patent
Suciu et al.

(10) Patent No.: US 8,961,132 B2
(45) Date of Patent: Feb. 24, 2015

(54) SECONDARY FLOW ARRANGEMENT FOR SLOTTED ROTOR

(75) Inventors: Gabriel L. Suciu, Glastonbury, CT (US); Christopher M. Dye, San Diego, CA (US); William K. Ackermann, East Hartford, CT (US); Stephen P. Muron, Columbia, CT (US); Ioannis Alvanos, West Springfield, MA (US); Brian D. Merry, Andover, CT (US); Arthur M. Salve, Tolland, CT (US); James W. Norris, Lebanon, CT (US)

(73) Assignee: United Technologies Corporation, Hartford, CT (US)

( * ) Notice: Subject to any disclaimer, the term of this patent is extended or adjusted under 35 U.S.C. 154(b) by 403 days.

(21) Appl. No.: 13/459,474

(22) Filed: Apr. 30, 2012

(65) Prior Publication Data

US 2013/0108413 A1 May 2, 2013

Related U.S. Application Data

(63) Continuation-in-part of application No. 13/283,689, filed on Oct. 28, 2011.

(51) Int. Cl.
*F01D 5/06* (2006.01)
*F01D 11/00* (2006.01)

(52) U.S. Cl.
CPC ..... *F01D 11/006* (2013.01); *F01D 5/066* (2013.01)
USPC ..... 416/96 R; 416/198 A

(58) Field of Classification Search
USPC ..... 416/95, 193 A, 198 A, 198 R
See application file for complete search history.

(56) References Cited

U.S. PATENT DOCUMENTS

| | | | | |
|---|---|---|---|---|
| 2,656,147 | A * | 10/1953 | Brownhill et al. | 416/97 R |
| 3,709,631 | A * | 1/1973 | Karstensen et al. | 416/95 |
| 4,127,359 | A * | 11/1978 | Stephan | 416/198 A |
| 4,468,148 | A | 8/1984 | Seymour | |
| 4,795,307 | A * | 1/1989 | Liebl | 415/115 |
| 5,340,274 | A * | 8/1994 | Cunha | 415/115 |
| 5,741,119 | A * | 4/1998 | Heppenstall | 416/219 R |
| 6,234,746 | B1 | 5/2001 | Schroder et al. | |
| 6,370,866 | B2 * | 4/2002 | Marushima et al. | 60/805 |
| 6,405,538 | B1 * | 6/2002 | Akiyama et al. | 60/782 |
| 6,514,038 | B2 * | 2/2003 | Akiyama et al. | 415/116 |
| 6,551,056 | B2 | 4/2003 | Rau | |
| 6,585,482 | B1 | 7/2003 | Liotta et al. | |
| 7,520,718 | B2 * | 4/2009 | Engle | 415/173.7 |
| 7,993,102 | B2 | 8/2011 | Desai et al. | |
| 8,376,689 | B2 * | 2/2013 | Bhagavatheeswaran et al. | 415/115 |
| 2010/0124495 | A1 * | 5/2010 | Bifulco | 415/216.1 |
| 2010/0232944 | A1 | 9/2010 | Hatman | |
| 2011/0162387 | A1 | 7/2011 | Chir | |

(Continued)

OTHER PUBLICATIONS

U.S. Appl. No. 13/283,689, filed Oct. 28, 2011.

(Continued)

*Primary Examiner* — Liam McDowell
(74) *Attorney, Agent, or Firm* — Carlson, Gaskey & Olds, PC

(57) ABSTRACT

A rotor for a gas turbine engine includes a plurality of blades which extend from a rotor disk and at least one spacer adjacent to the plurality of blades. A flow passage is defined between the rotor disk and the blades and spacer. A plurality of inlets are formed within the spacer to pump air into the flow passage.

23 Claims, 15 Drawing Sheets

(56) References Cited

U.S. PATENT DOCUMENTS

| | | | | |
|---|---|---|---|---|
| 2011/0182745 | A1 | 7/2011 | Suciu | |
| 2012/0027606 | A1* | 2/2012 | Malmborg | 416/223 A |
| 2012/0060507 | A1 | 3/2012 | King | |

OTHER PUBLICATIONS

U.S. Appl. No. 13/283,710, filed Oct. 28, 2011.
U.S. Appl. No. 13/283,782, filed Oct. 28, 2011.
U.S. Appl. No. 13/283,733, filed Oct. 28, 2011.

* cited by examiner

SECONDARY FLOW ARRANGEMENT FOR SLOTTED ROTOR

RELATED APPLICATION

This application is a continuation-in-part of U.S. application Ser. No. 13/283,689 which was filed on Oct. 28, 2011.

BACKGROUND

The present disclosure relates to a gas turbine engine, and more particularly to a rotor system therefor.

Gas turbine rotor systems include successive rows of blades, which extend from respective rotor disks that are arranged in an axially stacked configuration. The rotor stack may be assembled through a multitude of systems such as fasteners, fusion, tie-shafts and combinations thereof.

Gas turbine rotor systems operate in an environment in which significant pressure and temperature differentials exist across component boundaries which primarily separate a core gas flow path and a secondary cooling flow path. For high-pressure, high-temperature applications, the components experience thermo-mechanical fatigue (TMF) across these boundaries. Although resistant to the effects of TMF, the components may be of a heavier-than-optimal weight for desired performance requirements.

Further, secondary flow systems are typically designed to provide cooling to turbine components, bearing compartments, and other high-temperature subsystems. These flow networks are subject to losses due to the length of flow passages, number of restrictions, and scarcity of airflow sources, which can reduce engine operating efficiency.

SUMMARY

In a featured embodiment, a rotor for a gas turbine engine has a rotor disk defined along an axis of rotation. A plurality of blades extend from the rotor disk. At least one spacer is positioned adjacent the plurality of blades to define a flow passage between the rotor disk and the blades and spacer. A plurality of inlets is formed within the at least one spacer to pump air into the flow passage.

In another embodiment according to the previous embodiment, the plurality of blades includes at least a first set of blades and a second set of blades spaced axially aft of the first set of blades. The at least one spacer comprises at least a first spacer positioned upstream of the first set of blades and a second spacer positioned between the first and second sets of blades. The plurality of inlets is formed within the first spacer.

In another embodiment according to any of the previous embodiments, the rotor disk includes a rotor outer peripheral surface. The first and second sets of blades are supported on platforms that have a blade inner surface that faces the rotor outer peripheral surface. The spacers include a spacer inner surface that faces the rotor outer peripheral surface. The flow passage is defined between the rotor outer peripheral surface and the blade and rotor inner surfaces.

In another embodiment according to any of the previous embodiments, the flow passage includes an outlet configured to direct cooling airflow in to a turbine section.

In another embodiment according to any of the previous embodiments, the turbine section comprises a high pressure turbine.

In another embodiment according to any of the previous embodiments, the plurality of blades comprise compressor blades.

In another embodiment according to any of the previous embodiments, the plurality of blades are integrally formed as one piece with the rotor disk.

In another embodiment according to any of the previous embodiments, the plurality of blades are formed from a first material and the rotor disk is formed from a second material that is different from the first material. The plurality of blades are bonded to the rotor disk at an interface.

In another embodiment according to any of the previous embodiments, the plurality of blades are high pressure compressor blades.

In another embodiment according to any of the previous embodiments, the at least one spacer is integrally formed as one piece with the rotor disk.

In another embodiment according to any of the previous embodiments, the at least one spacer is formed from a first material and the rotor disk is formed from a second material that is different from the first material. The at least one spacer is bonded to the rotor disk at an interface.

In another embodiment according to any of the previous embodiments, the flow passage is sealed by axial seals extending axially along the blades and tangential seals extending circumferentially about the axis of rotation between the at least one spacer and the plurality of blades.

In another featured embodiment, a gas turbine engine has a compressor section including a rotor disk rotatable about an axis, a plurality of blades comprising at least a first set of blades and a second set of blades spaced axially aft of the first set of blades, and a plurality of spacers comprising at least a first spacer positioned upstream of the first set of blades and a second spacer positioned between the first and second sets of blades. A flow passage is defined between an outer peripheral surface of the rotor disk and inner surfaces of the blades and the spacers. A plurality of inlets are formed within the first spacer to pump air into the flow passage. A turbine section is configured to receive air pumped out of the flow passage.

In another embodiment according to the previous embodiment, the compressor section comprises a high pressure compressor and the turbine section comprises a high pressure turbine.

In another embodiment according to any of the previous embodiments, the plurality of inlets comprise discrete openings that are circumferentially spaced apart from each other about the axis.

In another embodiment according to any of the previous embodiments, the plurality of blades includes a third set of blades positioned axially aft of the second set of blades. The plurality of spacers includes a third spacer positioned between the second and third sets of blades. The flow passage extends in a generally axial direction from a location starting at the inlets at the first spacer and terminating at an outlet into the turbine section positioned aft of the third set of blades.

In another embodiment according to any of the previous embodiments, a turbine casing section is positioned aft of the third set of blades to define a turbine cavity that receives air exiting the flow passage.

In another embodiment according to any of the previous embodiments, a plurality of axial seals and tangential seals cooperate to seal the flow passage.

In another embodiment according to any of the previous embodiments, the axial seals extend along a length of platform edges for adjacent blades.

In another embodiment according to any of the previous embodiments, the tangential seals extend circumferentially about the axis between fore and aft edges of the spacers and an associated fore and aft edge of platforms for the first and second sets of blades.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
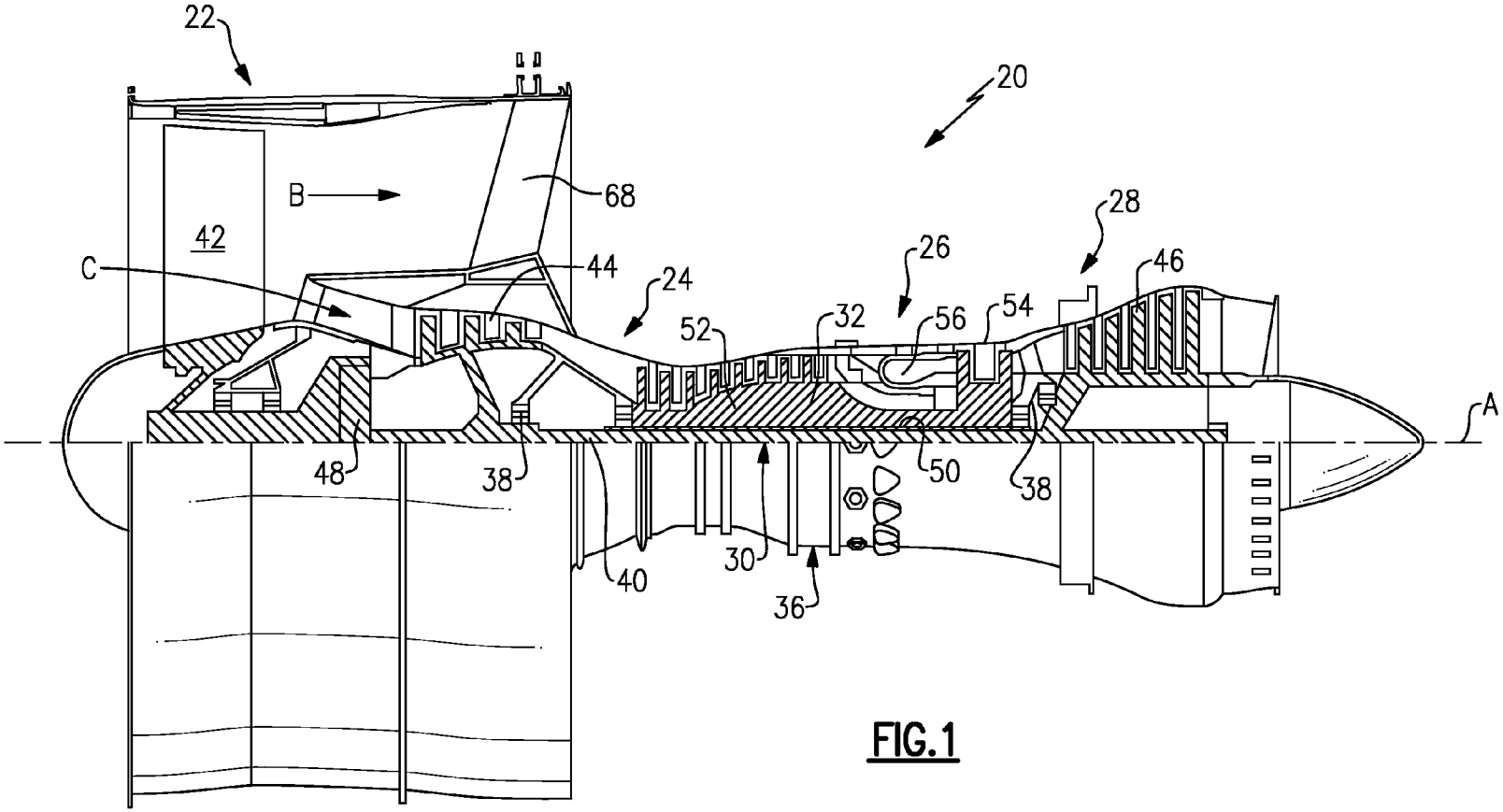
FIG. 1 is a schematic cross-sectional view of a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flowpath B while the compressor section 24 drives air along a core flowpath C for compression and communication into the combustor section 26 then expansion through the turbine section 28. Although depicted as a turbofan gas turbine engine in the disclosed non-limiting embodiment, it should be understood that the concepts described herein are not limited to use with turbofans as the teachings may be applied to other types of turbine engines, such as three-spool architectures.

The engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided.

The low speed spool 30 generally includes an inner shaft 40 that interconnects a fan 42, a low pressure compressor 44 and a low pressure turbine 46. The inner shaft 40 may be connected to the fan 42 directly or through a geared architecture 48 to drive the fan 42 at a lower speed than the low speed spool 30 which in one disclosed non-limiting embodiment includes a gear reduction ratio of, for example, at least 2.3:1. The high speed spool 32 includes an outer shaft 50 that interconnects a high pressure compressor (HPC) 52 and high pressure turbine (HPT) 54. A combustor 56 is arranged between the high pressure compressor 52 and the high pressure turbine 54. The inner shaft 40 and the outer shaft 50 are concentric and rotate about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The turbines 54, 46 rotationally drive the respective low speed spool 30 and high speed spool 32 in response to the expansion.

Figure 2:
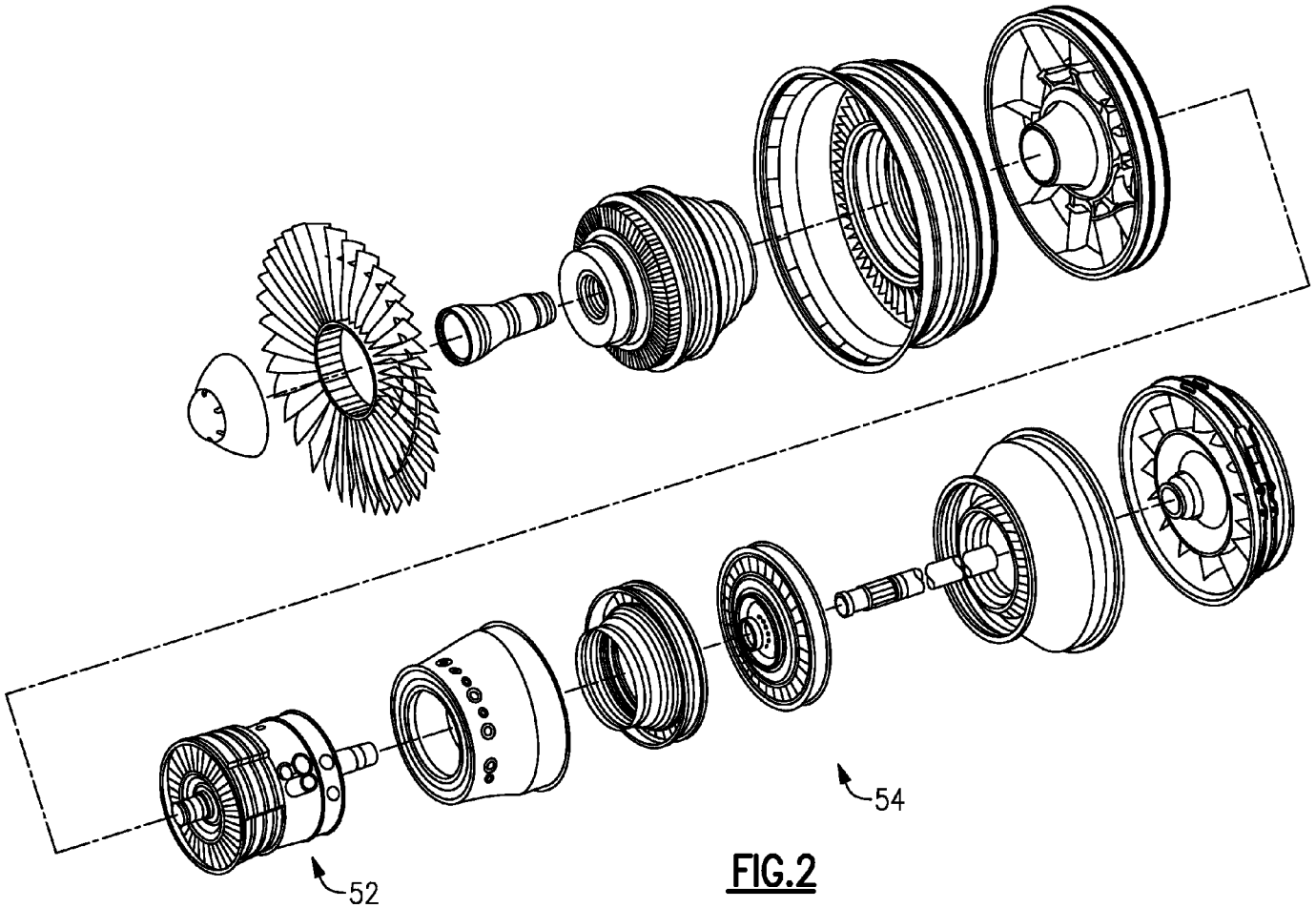
FIG. 2 is an exploded view of the gas turbine engine separated into primary build modules.

The gas turbine engine 20 is typically assembled in build groups or modules (FIG. 2). In the illustrated embodiment, the high pressure compressor 52 includes eight stages and the high pressure turbine 54 includes two stages in a stacked arrangement. It should be appreciated, however, that any number of stages will benefit herefrom as well as other engine sections such as the low pressure compressor 44 and the low pressure turbine 46. Further, other gas turbine architectures such as a three-spool architecture with an intermediate spool will also benefit herefrom as well.

Figure 3:
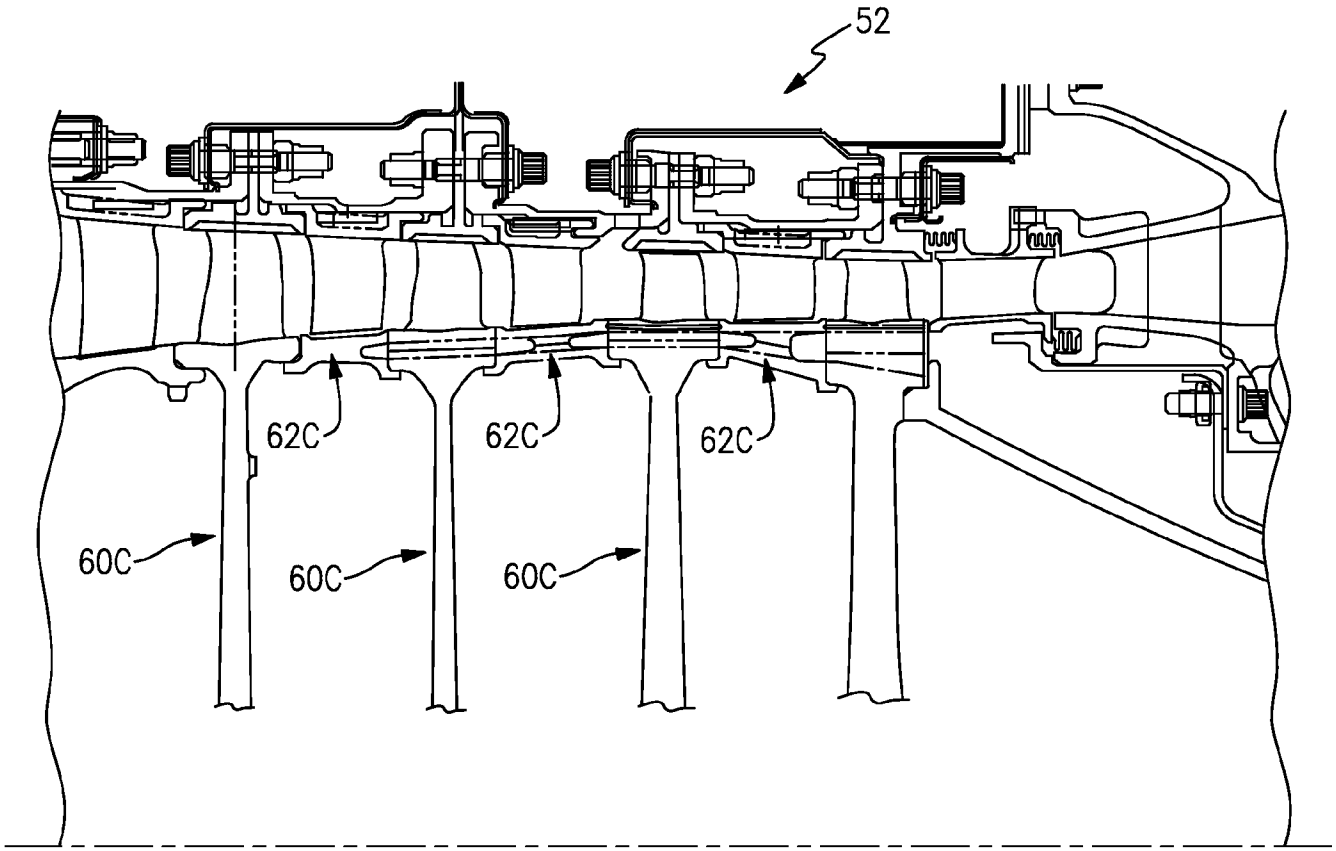
FIG. 3 is an enlarged schematic cross-sectional view of a high pressure compressor section of the gas turbine engine.

With reference to FIG. 3, the high pressure compressor (HPC) 52 is assembled from a plurality of successive HPC rotors 60C which alternate with HPC spacers 62C arranged in a stacked configuration. The rotor stack may be assembled in a compressed tie-shaft configuration, in which a central shaft (not shown) is assembled concentrically within the rotor stack and secured with a nut (not shown), to generate a preload that compresses and retains the HPC rotors 60C with the HPC spacers 62C together as a spool. Friction at the interfaces between the HPC rotor 60C and the HPC spacers 62C is solely responsible to prevent rotation between adjacent rotor hardware.

Figure 4:
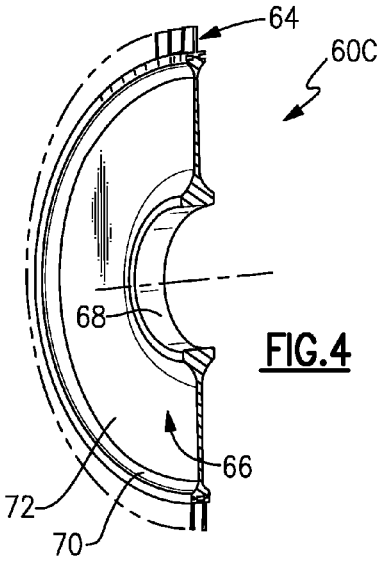
FIG. 4 is a perspective view of a rotor of the high pressure compressor section.

With reference to FIG. 4, each HPC rotor 60C generally includes a plurality of blades 64 circumferentially disposed around a rotor disk 66. The rotor disk 66 generally includes a hub 68, a rim 70, and a web 72 which extends therebetween. Each blade 64 generally includes an attachment section 74, a platform section 76 and an airfoil section 78 (FIG. 5A).

The HPC rotor 60C may be a hybrid dual alloy integrally bladed rotor (IBR) in which the blades 64 are manufactured of one type of material and the rotor disk 66 is manufactured of different material. Bi-metal construction provides material capability to separately address different temperature requirements. For example, the blades 64 are manufactured of a single crystal nickel alloy that are transient liquid phase bonded with the rotor disk 66 which is manufactured of a different material such as an extruded billet nickel alloy.

Alternatively, or in addition to the different materials, the blades 64 may be subject to a first type of heat treat and the rotor disk 66 to a different heat treat. That is, the Bi-metal construction as defined herein includes different chemical compositions as well as different treatments of the same chemical compositions such as that provided by differential heat treatment.

Figure 5A:
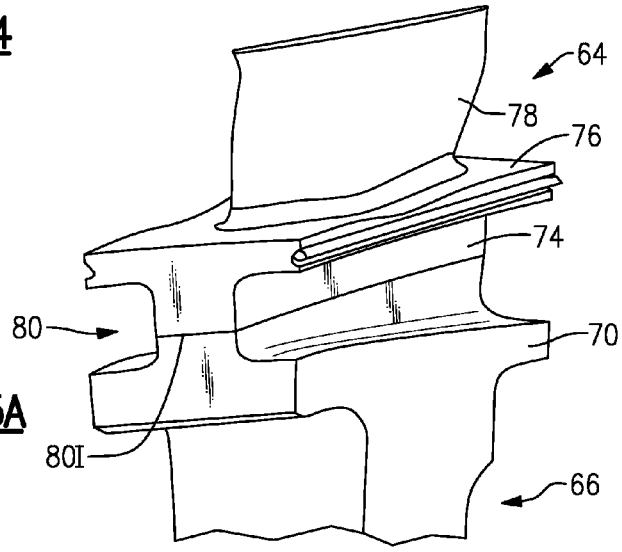
FIG. 5A is an expanded partial sectional perspective view of the rotor of FIG. 4.

With reference to FIG. 5A, a spoke 80 is defined between the rim 70 and the attachment section 74. The spoke 80 is a circumferentially reduced section defined by interruptions which produce axial or semi-axial slots which flank each spoke 80. The spokes 80 may be machined, cut with a wire EDM or other processes to provide the desired shape. An interface 801 that defines the transient liquid phase bond and or heat treat transition between the blades 64 and the rotor disk 66 are defined within the spoke 80. That is, the spoke 80 contains the interface 801. Heat treat transition as defined herein is the transition between differential heat treatments.

The spoke 80 provides a reduced area subject to the thermo-mechanical fatigue (TMF) across the relatively high temperature gradient between the blades 64 which are within the relatively hot core gas path and the rotor disk 66 which is separated therefrom and is typically cooled with a secondary cooling airflow.

Figure 5B:
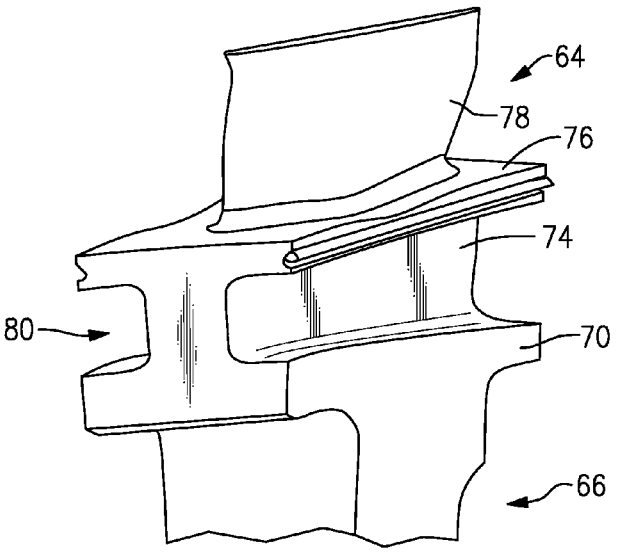
FIG. 5B is an expanded partial section perspective view of another rotor configuration.

In another example configuration shown in FIG. 5B, the blades 64 and rotor disk 66 of the HPC rotor 60C are formed from a common material. As such, the rotor disk 66, platform section 76, and airfoil portion 78 are integrally formed together as a single-piece component.

Figure 6A:
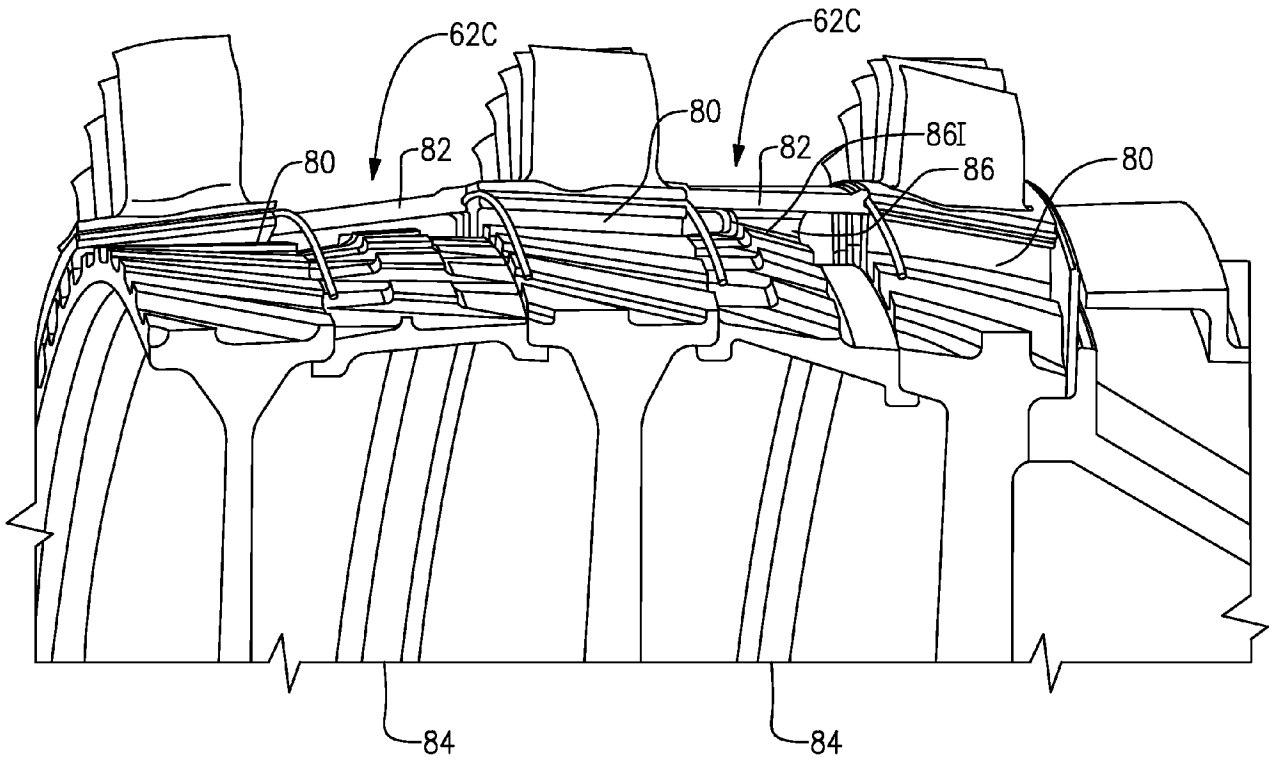
FIG. 6A is an expanded partial sectional perspective view of a portion of the high pressure compressor section.

With reference to FIG. 6A, the HPC spacers 62C provide a similar architecture to the HPC rotor 60C in which a plurality of core gas path seals 82 are bonded or otherwise separated from a rotor ring 84 at an interface 861 defined along a spoke 86. In one example, the seals 82 may be manufactured of the same material as the blades 64 and the rotor ring 84 may be manufactured of the same material as the rotor disk 66. That is, the HPC spacers 62C may be manufactured of a hybrid dual alloy which is a transient liquid phase bonded at the spoke 86. Alternatively, the HPC spacers 62C may be manufactured of a single material but subjected to the differential heat treat which transitions within the spoke 86. In another disclosed non-limiting embodiment, a relatively low-temperature configuration will benefit from usage of a single material such that the spokes 86 facilitate a weight reduction. In another disclosed non-limiting embodiment, low-temperature bi-metal designs may further benefit from dissimilar materials for weight reduction where, for example, low density materials may be utilized where load carrying capability is less critical.

The rotor geometry provided by the spokes 80, 86 reduces the transmission of core gas path temperature via conduction to the rotor disk 66 and the seal ring 84. The spokes 80, 86 enable an IBR rotor to withstand increased T3 levels with currently available materials. Rim cooling may also be reduced from conventional allocations. In addition, the overall configuration provides weight reduction at similar stress levels to current configurations.

The spokes 80, 86 in the disclosed non-limiting embodiment are oriented at a slash angle with respect to the engine axis A to minimize windage and the associated thermal effects. That is, the spokes are non-parallel to the engine axis A.

As discussed above, FIG. 6A discloses a configuration where the HPC spacers 62C are formed of one material while the rotor disk 66 is formed of a different material in a manner similar to that with the blades 64 and rotor disk 66 as discussed above in reference to FIG. 5A. The spokes 86 provide a reduced area subject to the thermo-mechanical fatigue (TMF) across the relatively high temperature gradient between the spacers 62C which are within the relatively hot core gas path and the rotor disk 66 which is separated therefrom and is typically cooled with a secondary cooling airflow.

Figure 6B:
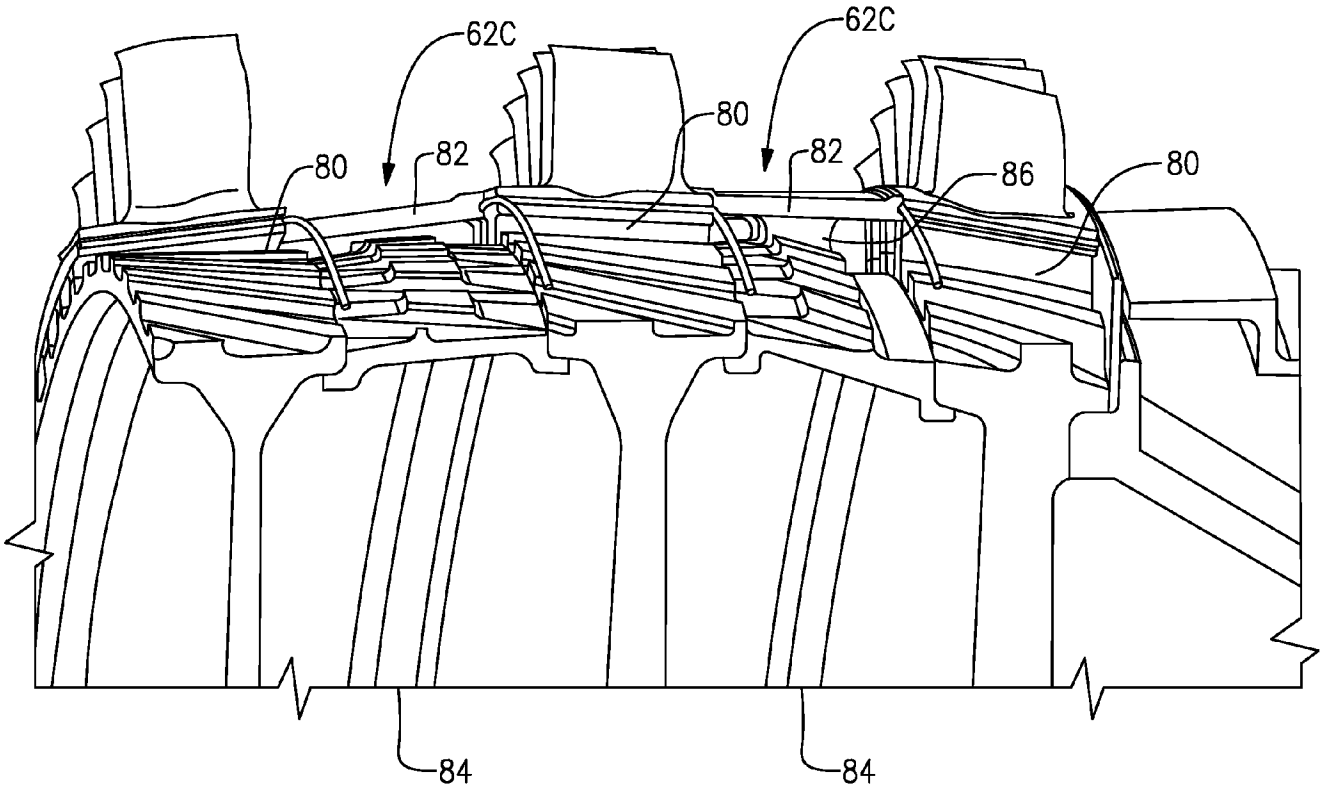
FIG. 6B is an expanded partial sectional perspective view of another configuration of a portion of the high pressure compressor section.

In another example configuration shown in FIG. 6B, the spacers 62C and rotor ring 84 of the HPC rotor 60C are formed from a common material. As such, the rotor ring 84 and spacer 62C are integrally formed together as a single-piece component.

Figure 7:
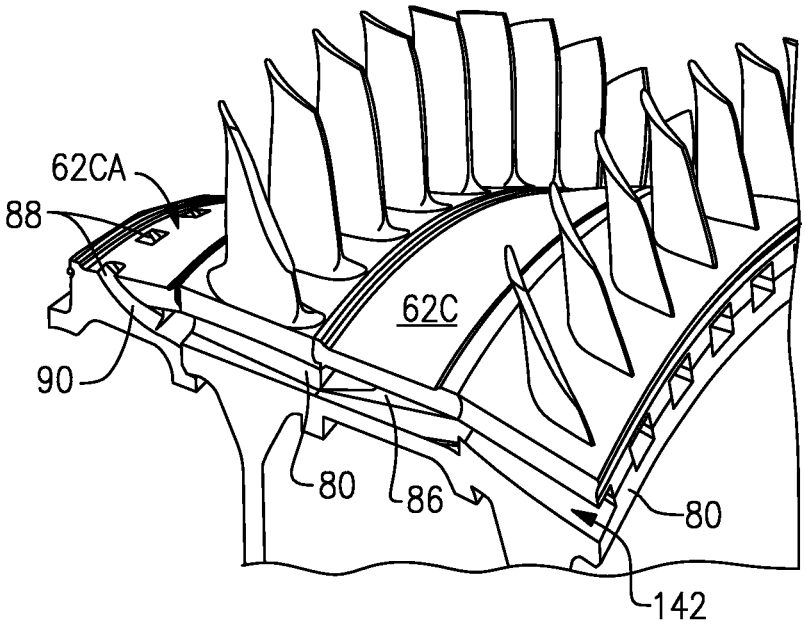
FIG. 7 is a top partial sectional perspective view of a portion of the high pressure compressor section with an outer directed inlet.

With reference to FIG. 7, the passages which flank the spokes 80, 86 may also be utilized to define airflow paths to receive an airflow from an inlet HPC spacer 62CA. The inlet HPC spacer 62CA includes a plurality of inlets 88 which may include a ramped flow duct 90 to communicate an airflow into the passages defined between the spokes 80, 86. The airflow may be core gas path flow which is communicated from an upstream, higher pressure stage for use in a later section within the engine such as the turbine section 28.

It should be appreciated that various flow paths may be defined through combinations of the inlet HPC spacers 62CA to include but not limited to, core gas path flow communication, secondary cooling flow, or combinations thereof. The airflow may be communicated not only forward to aft toward the turbine section, but also aft to forward within the engine 20. Further, the airflow may be drawn from adjacent static structure such as vanes to effect boundary flow turbulence as well as other flow conditions. That is, the HPC spacers 62C and the inlet HPC spacer 62CA facilitate through-flow for use in rim cooling, purge air for use downstream in the compressor, turbine, or bearing compartment operation.

Figure 8:
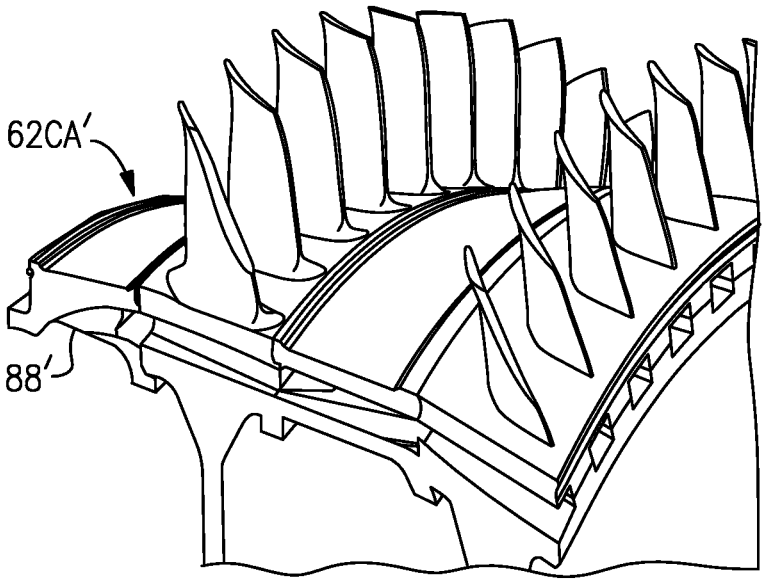
FIG. 8 is a top partial sectional perspective view of a portion of the high pressure compressor section with an inner directed inlet.

In another disclosed non-limiting embodiment, the inlets 88' may be located through the inner diameter of an inlet HPC spacer 62CA' (FIG. 8). The inlet HPC spacer 62CA' may be utilized to, for example, communicate a secondary cooling flow along the spokes 80, 86 to cool the spokes 80, 86 as well as communicate secondary cooling flow to other sections of the engine 20.

In another disclosed non-limiting embodiment, the inlets 88, 88' may be arranged with respect to rotation to essentially "scoop" and further pressurize the flow. That is, the inlets 88, 88' include a circumferential directional component.

Figure 9:
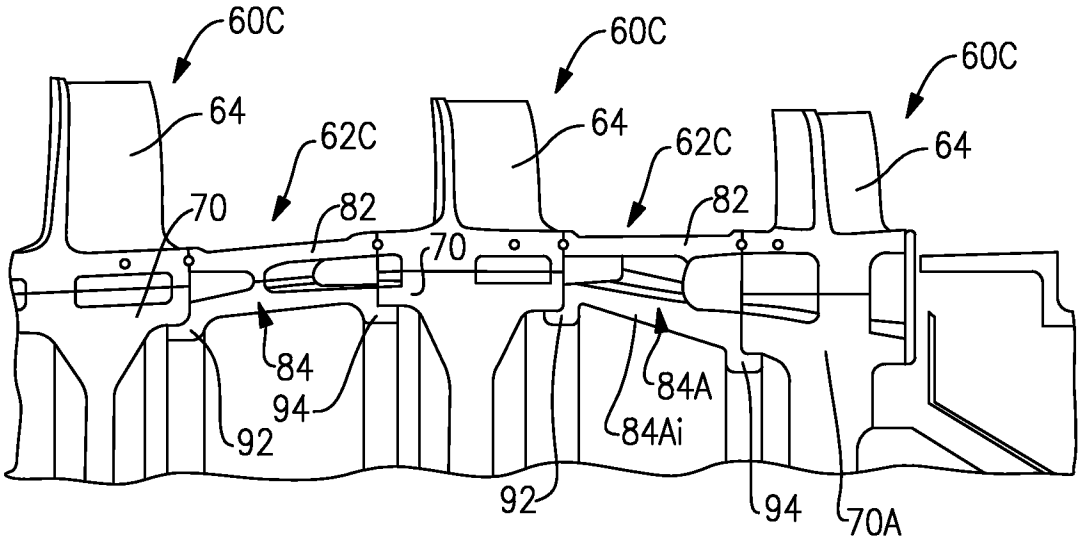
FIG. 9 is an expanded partial sectional view of a portion of the high pressure compressor section.

With reference to FIG. 9, each rotor ring 84 defines a forward circumferential flange 92 and an aft circumferential flange 94 which is captured radially inboard of the associated adjacent rotor rim 70. That is, each rotor ring 84 is captured therebetween in the stacked configuration. In the disclosed tie-shaft configuration with multi-metal rotors, the stacked configuration is arranged to accommodate the relatively lower-load capability alloys on the core gas path side of the rotor hardware, yet maintain the load-carrying capability between the seal rings 84 and the rims 70 to transmit rotor torque.

That is, the alternating rotor rim 70 to seal ring 84 configuration carries the rotor stack preload—which may be upward of 150,000 lbs—through the high load capability material of the rotor rim 70 to seal ring 84 interface, yet permits the usage of a high temperature resistant, yet lower load capability materials in the blades 64 and the seal surface 82 which are within the high temperature core gas path. Divorce of the sealing area from the axial rotor stack load path facilitates the use of a disk-specific alloy to carry the stack load and allows for the high-temp material to only seal the rotor from the flow path. That is, the inner diameter loading and outer diameter sealing permits a segmented airfoil and seal platform design which facilitates relatively inexpensive manufacture and highly contoured airfoils. The disclosed rotor arrangement facilitates a compressor inner diameter bore architectures in which the reduced blade/platform pull may be taken advantage of in ways that produce a larger bore inner diameter to thereby increase shaft clearance.

Figure 10:
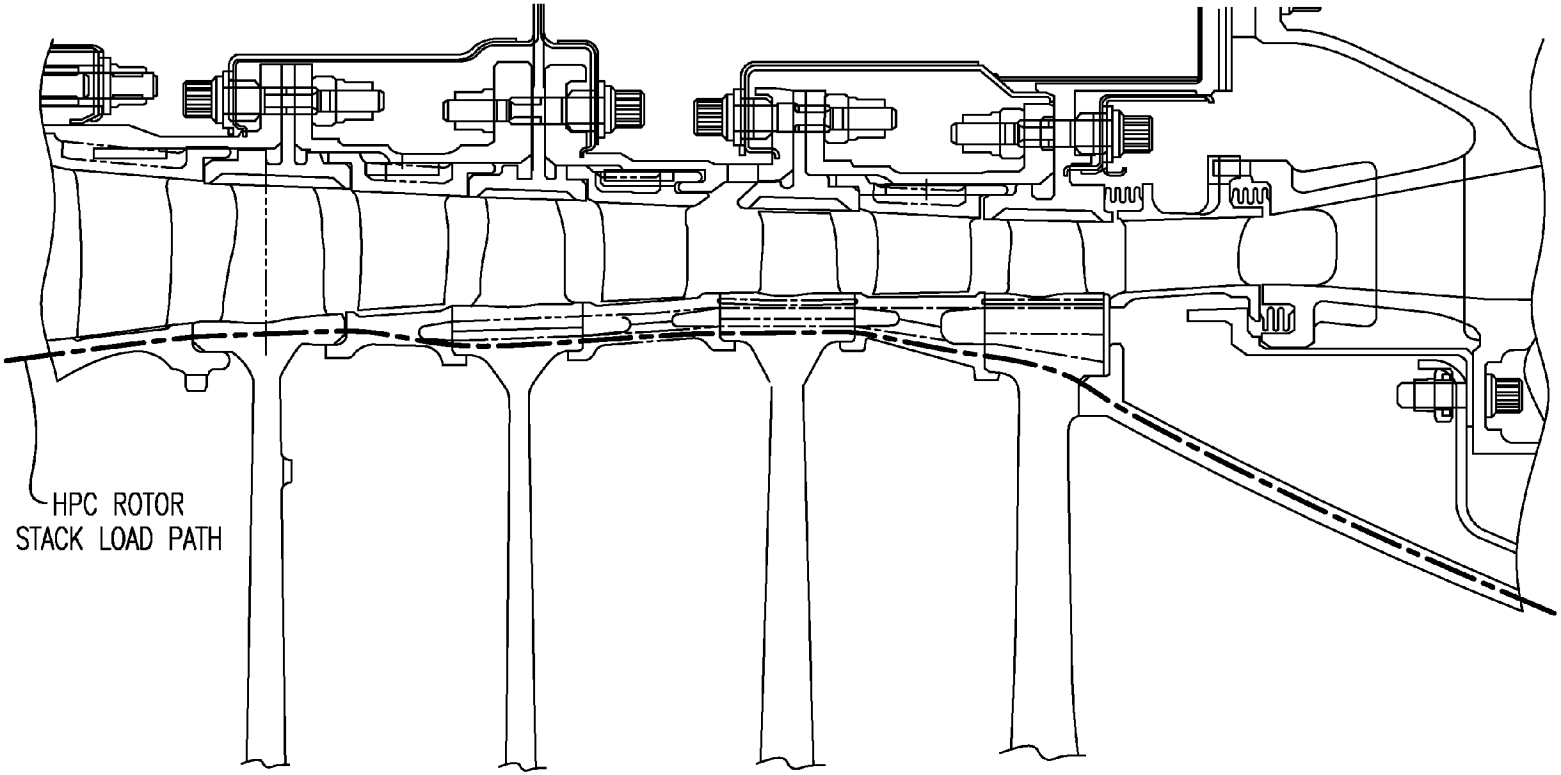
FIG. 10 is an expanded partial sectional perspective view of a portion of the high pressure compressor section illustrating a rotor stack load path.
Figure 11:
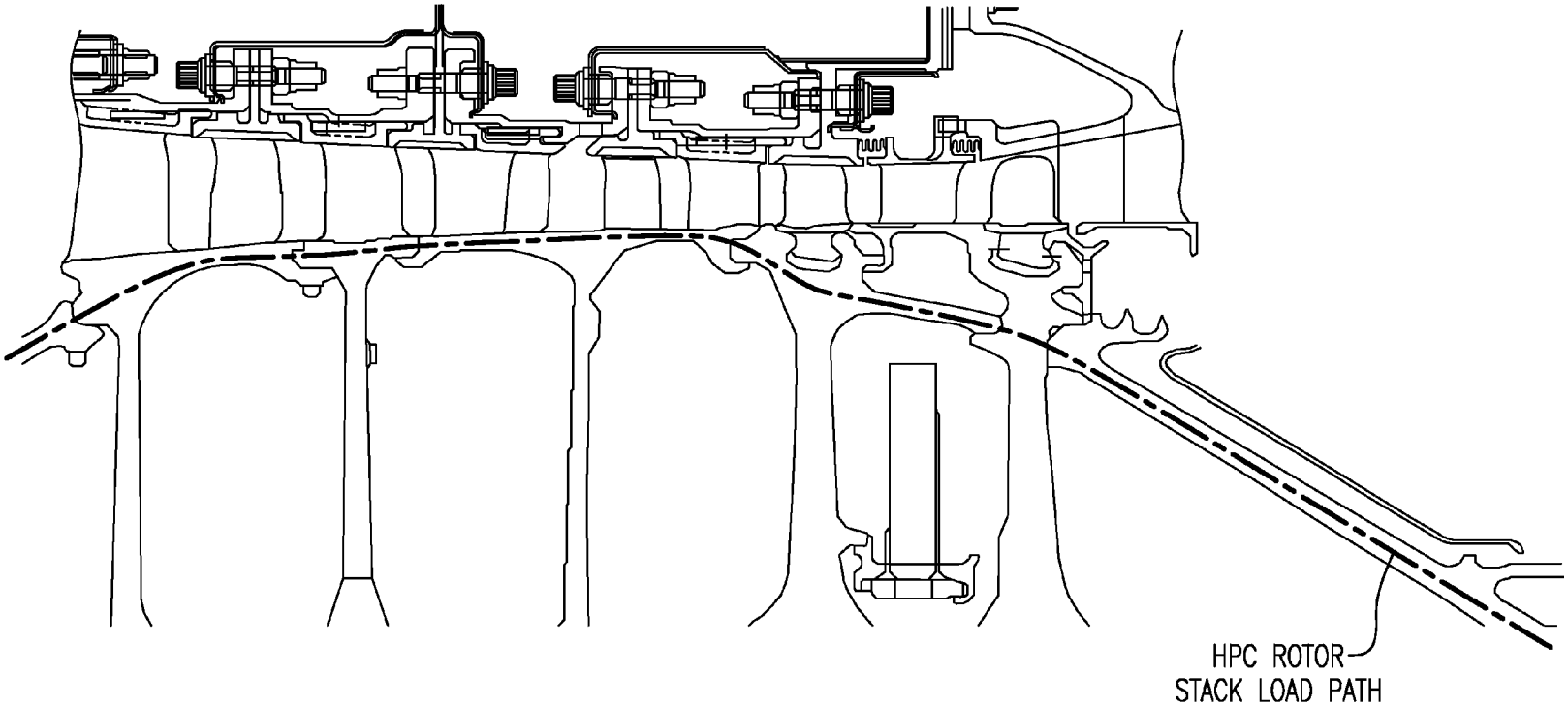
FIG.11 Related Art
FIG. 11 is a RELATED ART expanded partial sectional perspective view of a portion of the high pressure compressor section illustrating a more tortuous rotor stack load path.

The HPC spacers 62C and HPC rotors 60C of the IBR may also be axially asymmetric to facilitate a relatively smooth axial rotor stack load path (FIG. 10). The asymmetry may be located within particular rotor rims 70A and/or seal rings 84A (FIG. 9). For example, the seal ring 84A includes a thinner forward circumferential flange 92 compared to a thicker aft circumferential flange 94 with a ramped interface 84Ai. The ramped interface 84Ai provides a smooth rotor stack load path. Without tangentially slot assembled airfoils in an IBR, the load path along the spool may be designed in a more efficient manner as compared to the heretofore rather torturous conventional rotor stack load path (FIG. 11; RELATED ART).

Figure 12A:
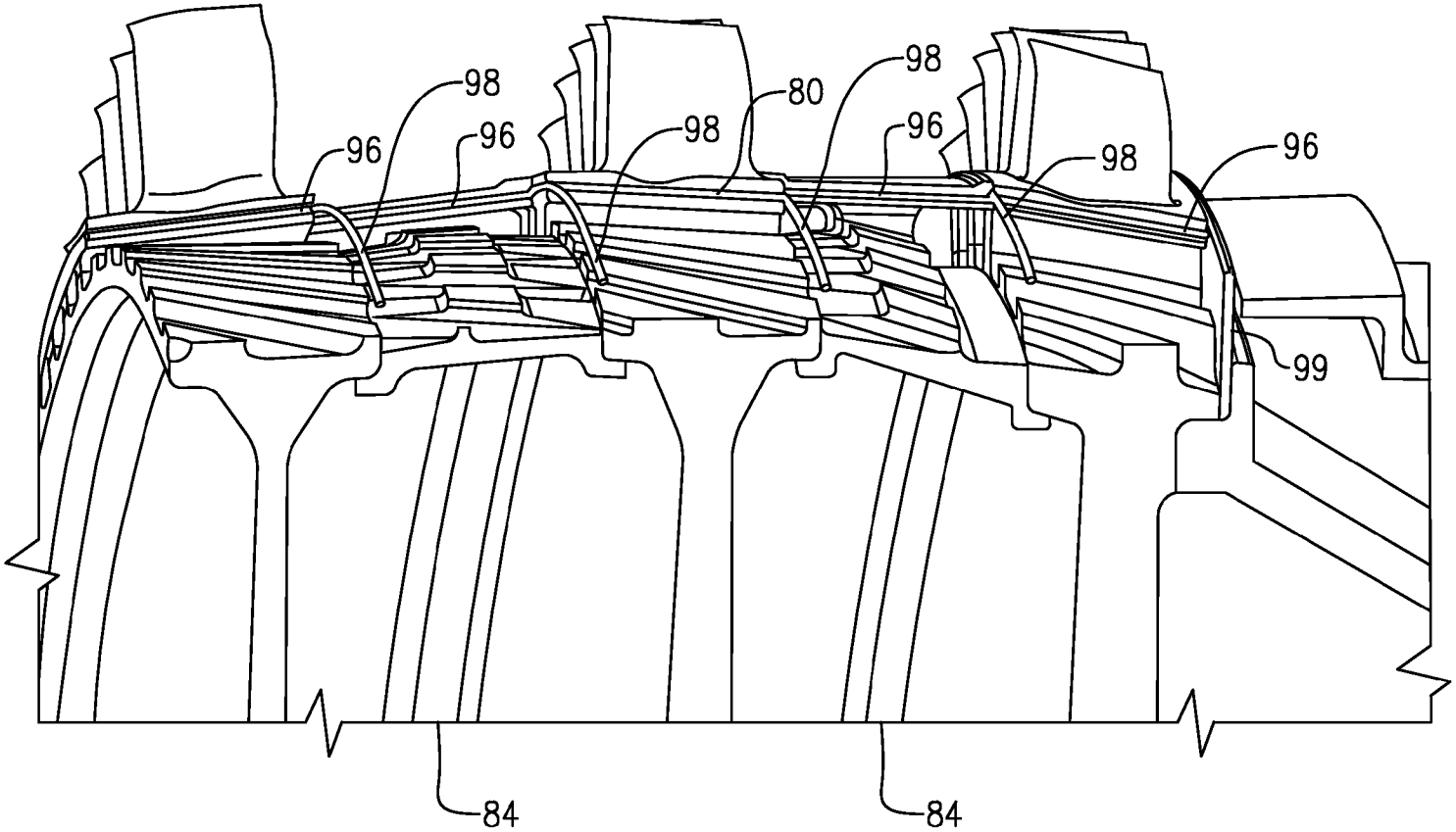
FIG. 12A is an expanded partial sectional perspective view of a portion of the high pressure compressor section illustrating a wire seal structure.
Figure 12B:
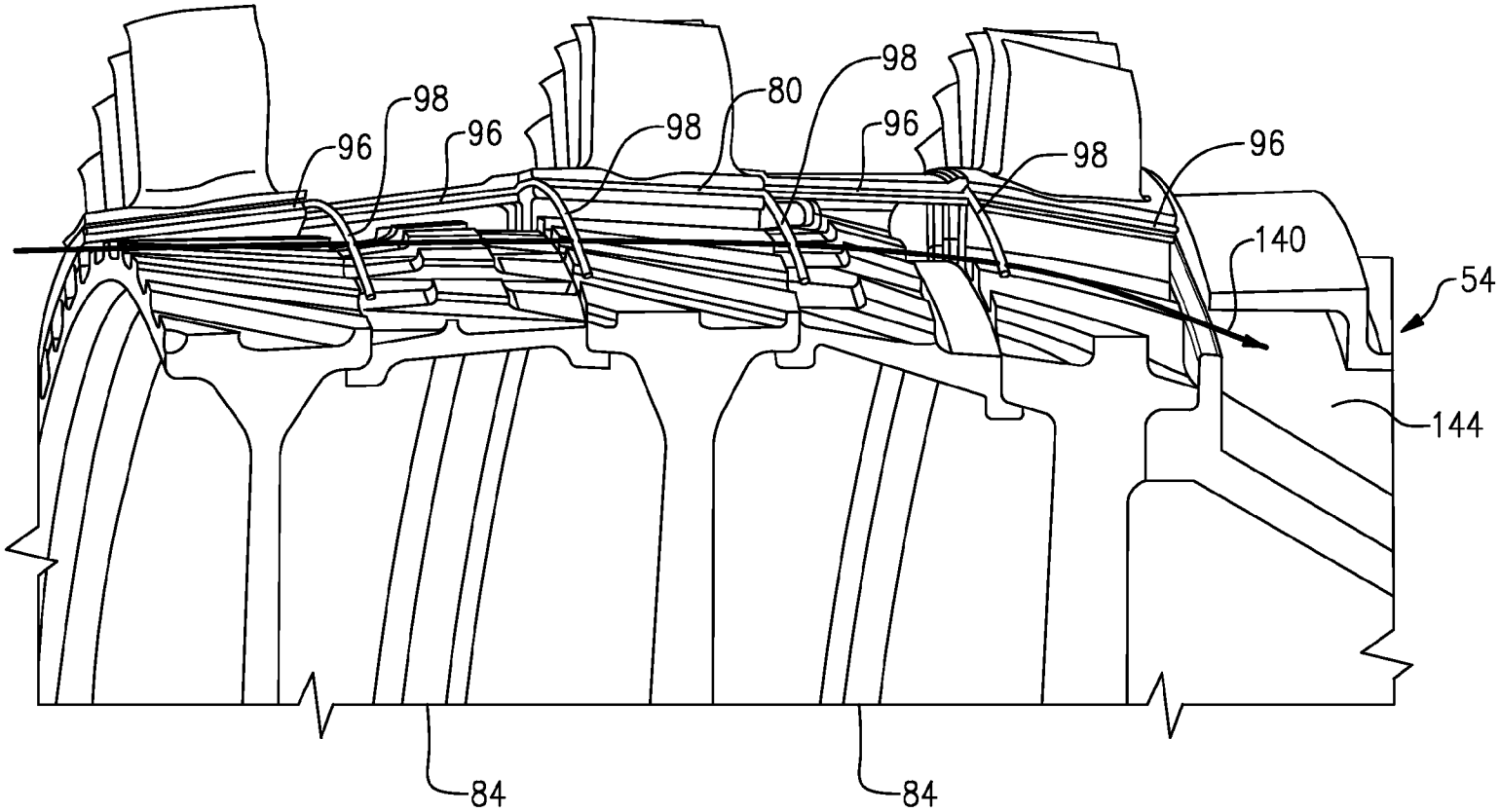
FIG. 12B is an expanded partial sectional perspective view of another configuration of a portion of the high pressure compressor section illustrating a wire seal structure.
Figure 13:
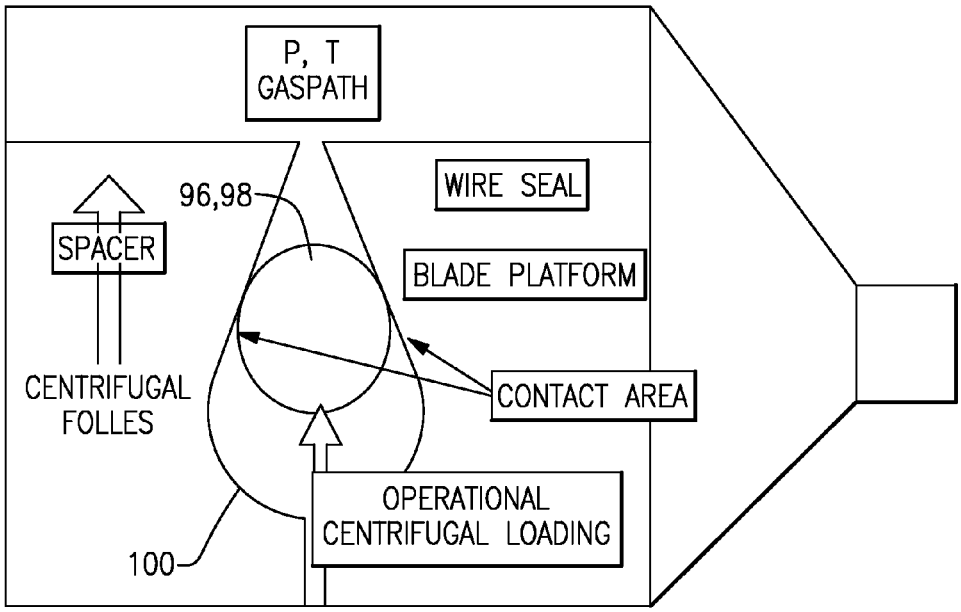
FIG. 13 is an expanded schematic view of the wire seal structure.

With reference to FIG. 12A, the blades 64 and seal surface 82 may be formed as segments that include axial wire seals 96 between each pair of the multiple of seal surfaces 82 and each pair of the multiple of blades 64 as well as tangential wire seals 98 between the adjacent HPC spacers 62C and HPC rotors 60C. The axial seals 96 extend between each blade and the tangential seals 98 extend about the rotor on each side of the spacer 62C. In one example, the axial seals 96 are configured to extend along a length of each edge of each blade platform 76 and the tangential seals 98 are configured to extend circumferentially about the axis A between fore and aft edges of each spacer 60*c* and the corresponding circumferential fore and aft edges of the platforms 76 for each set of blades 64. The tangential wire seals 96 and the axial wire seals 98 are located within teardrop shaped cavities 100 (FIG. 13) such that centrifugal forces increase the seal interface forces. FIG. 12B shows an improved secondary flow configuration that takes advantage of the spoked rotor design to provide additional cooling to the high pressure turbine (HPT) 54 as indicated by arrow 140. This configuration entrains air from the engine gaspath at a mid-compressor location and flows through spokes in the disk 66 and spacer 62C portions of the HPC rotors 60C. Flow exits at the aft rotor location and combines with additional air flow to be delivered to a second blade of the HPT 54. As such, in this arrangement, existing hardware is utilized for secondary flow geometry to allow elimination of pumps at the aft end of the HPC 52. This cooling system can be utilized in any configuration where sufficient flow passes through slotted rotor geometry at sufficient driving pressures.

As shown in FIG. 7, the inlets 88 communicate air into passages 142 defined between the spokes 80, 86, which then empty into cavities 144 (FIG. 12B) of the HPT 54. The inlets 88 essentially cooperate with each other to comprise a pump that directs cooling air into the HPT 54. The cavity 144 is at a lower pressure than the pressure that exists at the inlets 88, and thus serves to act as a sink, i.e. suction source. In the example shown, the inlets 88 pump high pressure air from the 5-6 compressor stage into the HPT station 4.5 location.

FIG. 12A shows a potential "seal" option if the secondary cooling scheme of FIG. 12B is not vented to station 4.5. In this configuration, a wall structure 99 is positioned aft of the last set of blades 64. This could be used in an application with moderately elevated T3 temperatures, where the rotor construction does not include the bond to join two different materials. In this case the thermal gradient is retarded by the length of the spoke; therefore an abrupt throttle change (more power) would not create an instantaneous TMF rotor (full hoop) stress increase.

Although the high pressure compressor (HPC) 52 is discussed in detail above, it should be appreciated that the high pressure turbine (HPT) 54 (FIG. 14) is similarly assembled from a plurality of successive respective HPT rotor disks 60T which alternate with HPT spacers 62T (FIG. 15) arranged in a stacked configuration and the disclosure with respect to the high pressure compressor (HPC) 52 is similarly applicable to the high pressure turbine (HPT) 54 as well as other spools of the gas turbine engine 20 such as a low spool and an intermediate spool of a three-spool engine architecture. That is, it should be appreciated that other sections of a gas turbine engine may alternatively or additionally benefit herefrom.

Figure 14:
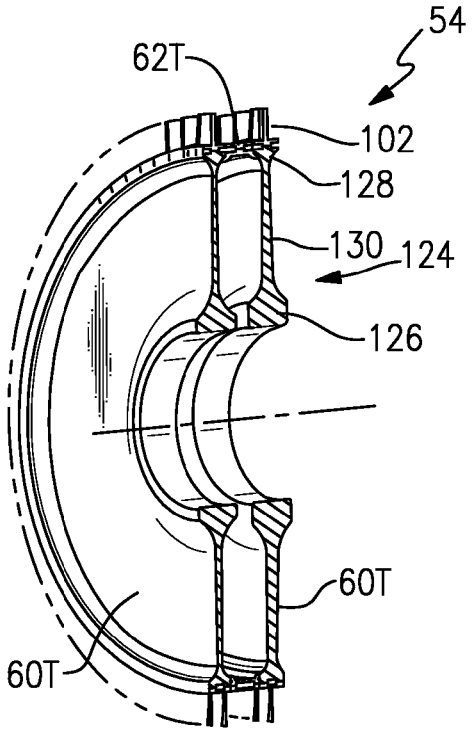
FIG. 14 is an expanded partial sectional perspective view of a high pressure turbine section.
Figure 16:
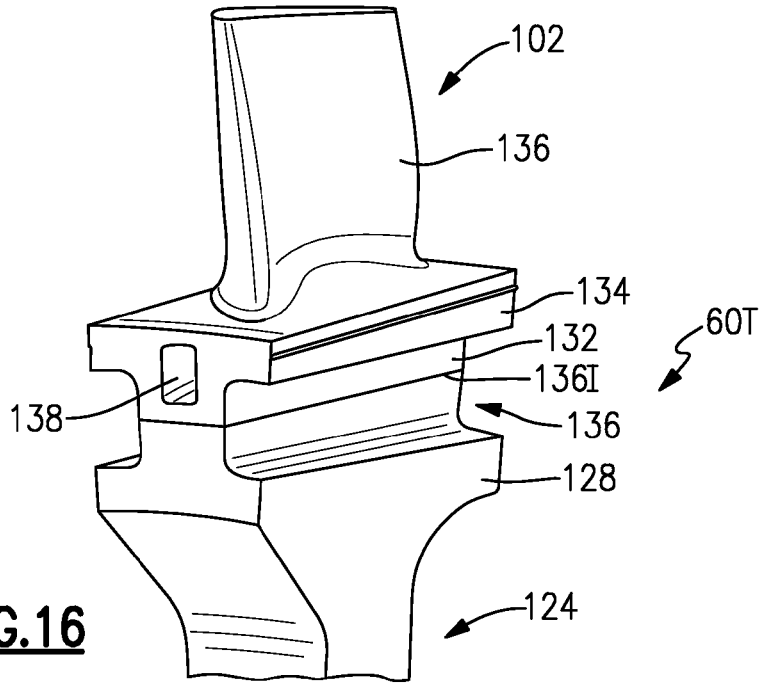
FIG. 16 is an expanded partial sectional perspective view of the rotor of FIG. 15.
Figure 15:
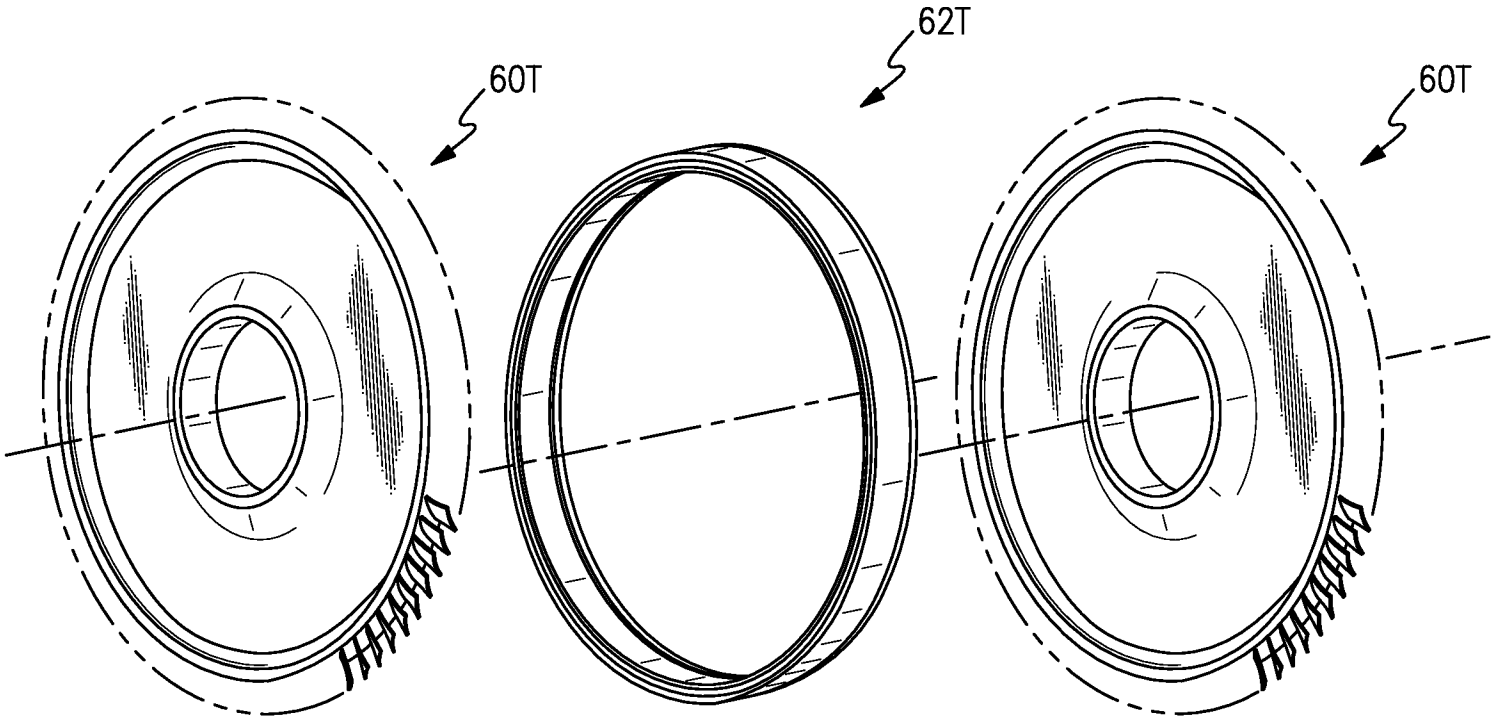
FIG. 15 is an expanded exploded view of the high pressure turbine section.

With reference to FIG. 14, each HPT rotor 60T generally includes a plurality of blades 102 circumferentially disposed around a rotor disk 124. The rotor disk 124 generally includes a hub 126, a rim 128, and a web 130 which extends therebetween. Each blade 102 generally includes an attachment section 132, a platform section 134, and an airfoil section 136 (FIG. 16).

The blades 102 may be bonded to the rim 128 along a spoke 136 at an interface 1361 as with the high pressure compressor (HPC) 52. Each spoke 136 also includes a cooling passage 138 generally aligned with each turbine blade 102. The cooling passage 138 communicates a cooling airflow into internal passages (not shown) of each turbine blade 102.

It should be understood that like reference numerals identify corresponding or similar elements throughout the several drawings. It should also be understood that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed is:

1. A rotor for a gas turbine engine comprising:

a rotor disk defined along an axis of rotation, the rotor disc including a rotor outer peripheral surface;

a plurality of blades which extend from the rotor disk, wherein the blades are supported on platforms that have a blade inner surface that faces the rotor outer peripheral surface;

at least one spacer positioned adjacent the plurality of blades to define a flow passage between the rotor disk and the blades and spacer, wherein the spacers include a spacer outer peripheral surface and a spacer inner peripheral surface that faces the rotor outer peripheral surface, and wherein the flow passage is defined between the rotor outer peripheral surface and the blade and spacer inner surfaces; and a plurality of inlets formed within the at least one spacer to pump air into the flow passage, wherein the inlets extend through the at least one spacer from at least one of the spacer outer and inner peripheral surfaces to an end face of the at least one spacer such that air flows in a generally axial direction in the flow passage from the at least one spacer toward the rotor disk.

2. The rotor as recited in claim 1, wherein the plurality of blades includes at least a first set of blades and a second set of blades spaced axially aft of the first set of blades, and wherein the at least one spacer comprises at least a first spacer positioned upstream of the first set of blades and a second spacer positioned between the first and second sets of blades, and wherein the plurality of inlets is formed within the first spacer.

3. The rotor as recited in claim 1, wherein the flow passage includes an outlet configured to direct cooling airflow into a turbine section.

4. The rotor as recited in claim 3, wherein the turbine section comprises a high pressure turbine.

5. The rotor as recited in claim 4, wherein the plurality of blades comprise compressor blades.

6. The rotor as recited in claim 1, wherein the plurality of blades are integrally formed as one piece with the rotor disk.

7. The rotor as recited in claim 1, wherein the plurality of blades are high pressure compressor blades.

8. The rotor as recited in claim 1, wherein the at least one spacer is integrally formed as one piece with the rotor disk.

9. The rotor as recited in claim 1, wherein the plurality of blades comprise compressor blades, and wherein the at least one spacer comprises an inlet spacer positioned upstream of all stages of an associated compressor.

10. A rotor for a gas turbine engine comprising:

a rotor disk defined along an axis of rotation;

a plurality of blades which extend from the rotor disk, wherein the plurality of blades are formed from a first material and the rotor disk is formed from a second material that is different from the first material, and wherein the plurality of blades are bonded to the rotor disk at an interface;

at least one spacer positioned adjacent the plurality of blades to define a flow passage between the rotor disk and the blades and spacer; and a plurality of inlets formed within the at least one spacer to pump air into the flow passage.

11. A rotor for a gas turbine engine comprising:

a rotor disk defined along an axis of rotation;

a plurality of blades which extend from the rotor disk;

at least one spacer positioned adjacent the plurality of blades to define a flow passage between the rotor disk and the blades and spacer, wherein the at least one spacer is formed from a first material and an associated rotor ring is formed from a second material that is different from the first material, and wherein the at least one spacer is bonded to the rotor ring at an interface; and a plurality of inlets formed within the at least one spacer to pump air into the flow passage.

12. A rotor for a gas turbine engine comprising:

a rotor disk defined along an axis of rotation;

a plurality of blades which extend from the rotor disk;

at least one spacer positioned adjacent the plurality of blades to define a flow passage between the rotor disk and the blades and spacer, wherein the flow passage is sealed by axial seals extending axially along the blades and tangential seals extending circumferentially about the axis of rotation between the at least one spacer and the plurality of blades; and a plurality of inlets formed within the at least one spacer to pump air into the flow passage.

13. A gas turbine engine comprising:

a compressor section including a rotor disk rotatable about an axis, a plurality of blades comprising at least a first set of blades and a second set of blades spaced axially aft of the first set of blades, and a plurality of spacers comprising at least a first spacer positioned upstream of the first set of blades and a second spacer positioned between the first and second sets of blades;

a flow passage defined between an outer peripheral surface of the rotor disk and inner surfaces of the blades and the spacers;

a plurality of inlets formed within the first spacer to pump air into the flow passage, wherein the inlets extend through the first spacer from at least one of outer and inner peripheral surfaces of the first spacer to an end face of the first spacer such that air flows in a generally axial direction in the flow passage from the first spacer toward the first set of blades; and a turbine section configured to receive air pumped out of the flow passage.

14. The gas turbine engine as recited in claim 13, wherein the compressor section comprises a high pressure compressor and the turbine section comprises a high pressure turbine.

15. The gas turbine engine as recited in claim 13, wherein the plurality of inlets comprise discrete openings that are circumferentially spaced apart from each other about the axis.

16. The gas turbine engine as recited in claim 13, wherein the plurality of blades includes a third set of blades positioned axially aft of the second set of blades and wherein the plurality of spacers includes a third spacer positioned between the second and third sets of blades, and wherein the flow passage extends in a generally axial direction from a location starting at the inlets at the first spacer and terminating at an outlet into the turbine section positioned aft of the third set of blades.

17. The gas turbine engine as recited in claim 16, including a turbine casing section positioned aft of the third set of blades to define a turbine cavity that receives air exiting the flow passage.

18. The gas turbine engine as recited in claim 13, wherein the blades are formed from a first material and the rotor disk is formed from a second material that is different from the first material, and wherein the blades are bonded to the rotor disk at an interface.

19. The gas turbine engine as recited in claim 13, wherein at least one of the first and second spacers comprise a plurality of seals extending outwardly from a rotor ring, and wherein the seals are formed from a first material and the rotor ring is formed from a second material that is different from the first material, and wherein the seals are bonded to the rotor ring at an interface.

20. The gas turbine engine as recited in claim 13, wherein the first spacer comprises an inlet spacer that upstream of all compressor blades.

21. A gas turbine engine comprising:

a compressor section including a rotor disk rotatable about an axis, a plurality of blades comprising at least a first set of blades and a second set of Hades spaced axially aft of the first set of blades, and a plurality of spacers comprising at least a first spacer positioned upstream of the first set of blades and a second spacer positioned between the first and second sets of blades;

a flow passage defined between an outer peripheral surface of the rotor disk and inner surfaces of the blades and the spacers;

a plurality of inlets formed within the first spacer to pump air into the flow passage; and a turbine section configured to receive air pumped out of the flow passage;

a turbine section configured to receive air pumped out of the flow passage and a plurality of axial seals and tangential seals that cooperate to seal the flow passage.

22. The gas turbine engine as recited in claim 21, wherein the axial seals extend along a length of platform edges for adjacent blades.

23. The gas turbine engine as recited in claim 21, wherein the tangential seals extend circumferentially about the axis between fore and aft edges of the spacers and an associated fore and aft edge of platforms for the first and second sets of blades.

* * * * *

UNITED STATES PATENT AND TRADEMARK OFFICE

CERTIFICATE OF CORRECTION

PATENT NO. : 8,961,132 B2
APPLICATION NO. : 13/459474
DATED : February 24, 2015
INVENTOR(S) : Gabriel L. Suciu et al.

It is certified that error appears in the above-identified patent and that said Letters Patent is hereby corrected as shown below:

IN THE CLAIMS:

In claim 21, column 10, line 53; delete "Hades" and replace with --blades--

Signed and Sealed this
Tenth Day of November, 2015

Michelle K. Lee

Michelle K. Lee
*Director of the United States Patent and Trademark Office*